US007011264B2

(12) United States Patent
Shore et al.

(10) Patent No.: US 7,011,264 B2
(45) Date of Patent: Mar. 14, 2006

(54) LAYING HEAD FOR ROD ROLLING MILL

(75) Inventors: T. Michael Shore, Princeton, MA (US); William X. Shen, Boylston, MA (US); Peiliang L. Zhang, Shrewsbury, MA (US)

(73) Assignee: Morgan Construction Company, Worcester, MA (US)

( * ) Notice: Subject to any disclaimer, the term of this patent is extended or adjusted under 35 U.S.C. 154(b) by 182 days.

(21) Appl. No.: 10/457,274

(22) Filed: Jun. 9, 2003

(65) Prior Publication Data

US 2005/0001086 A1 Jan. 6, 2005

Related U.S. Application Data

(60) Provisional application No. 60/389,786, filed on Jun. 19, 2002.

(51) Int. Cl.
*B21C 47/10* (2006.01)

(52) U.S. Cl. ..... 242/361

(58) Field of Classification Search ..... 242/361, 242/361.2, 361.4

See application file for complete search history.

(56) References Cited

U.S. PATENT DOCUMENTS 4,353,513 A * 10/1982 Holthoff ..... 242/361
6,179,237 B1 1/2001 David et al.

FOREIGN PATENT DOCUMENTS

EP 0 779 115 A1 6/1997
EP 0 958 866 A2 11/1999
GB 943474 11/1960

* cited by examiner

*Primary Examiner*—John Q. Nguyen
(74) *Attorney, Agent, or Firm*—Gauthier & Connors, LLP

(57) ABSTRACT

In a laying head for forming a longitudinally moving hot rolled product into a helix, a tubular quill has a central axis of rotation and a through passageway extending along the central axis from a first end to an opposite second end of the quill. The interior quill surface has a cylindrical section leading from the first end of the passageway to a radially outwardly flared section which in turn leads to the second end of the passageway. A laying pipe is received in the through passageway. The laying pipe has an entry end aligned with the central axis at the first end of the passageway, a curved intermediate portion surrounded by the flared section of the interior quill surface, and an end portion projecting axially from the second end of the passageway to a delivery end spaced radially from the central axis. A first support at the first end of the passageway radially supports the entry end of the laying pipe, and a second support projects axially into the passageway from the second end of the quill to provide support for the curved intermediate portion of the laying pipe.

5 Claims, 2 Drawing Sheets

LAYING HEAD FOR ROD ROLLING MILL

CROSS REFERENCE TO RELATED APPLICATION

This application claims priority of provisional patent application Ser. No. 60/389,786 filed Jun. 19, 2002.

BACKGROUND DISCUSSION

1. Field of the Invention

This invention relates generally to laying heads for rod rolling mills, and is concerned in particular with an improvement in the manner in which the laying pipes are supported within the laying heads.

2. Description of the Prior Art

FIG. 1 depicts a conventional laying head having a tubular quill 10 supported between bearings (not shown) for rotation about an axis A. A laying pipe 12 has an entry end 12*a* aligned with the axis A for receiving hot rolled rod from the last roll stand of the mill. A three dimensionally curved intermediate portion 12*b* leads from the entry end 12*a* of the pipe to a delivery end 12*c* from which the rod is delivered as a helical formation of rings.

The outboard portion of the pipe projecting beyond the quill 10 is radially and axially supported by a series of clamps 14 carried on arranger plate 16 projecting from a tubular boss 18. However, the pipe portion contained within the quill is supported only radially at 20. During high speed operation of the laying head, the pipe portion within the quill is thus relatively free to deflect, causing accelerated wear in the region 22. Deflection is occasioned by centrifugal forces, and thermal expansion.

SUMMARY OF THE INVENTION

In accordance with the present invention, an interior surface of the quill is configured to conform to and to radially inwardly support the three dimensionally curved intermediate portion of the laying pipe. Preferably, an internal pipe support is axially received in the quill and is configured and dimensioned to confine the curved intermediate pipe portion against the conformed interior quill surface.

These and other features and advantages of the present inventor will now be described in greater detail with reference to the accompanying drawings, wherein:

DETAILED DESCRIPTION OF PREFERRED EMBODIMENT

Figure 1:
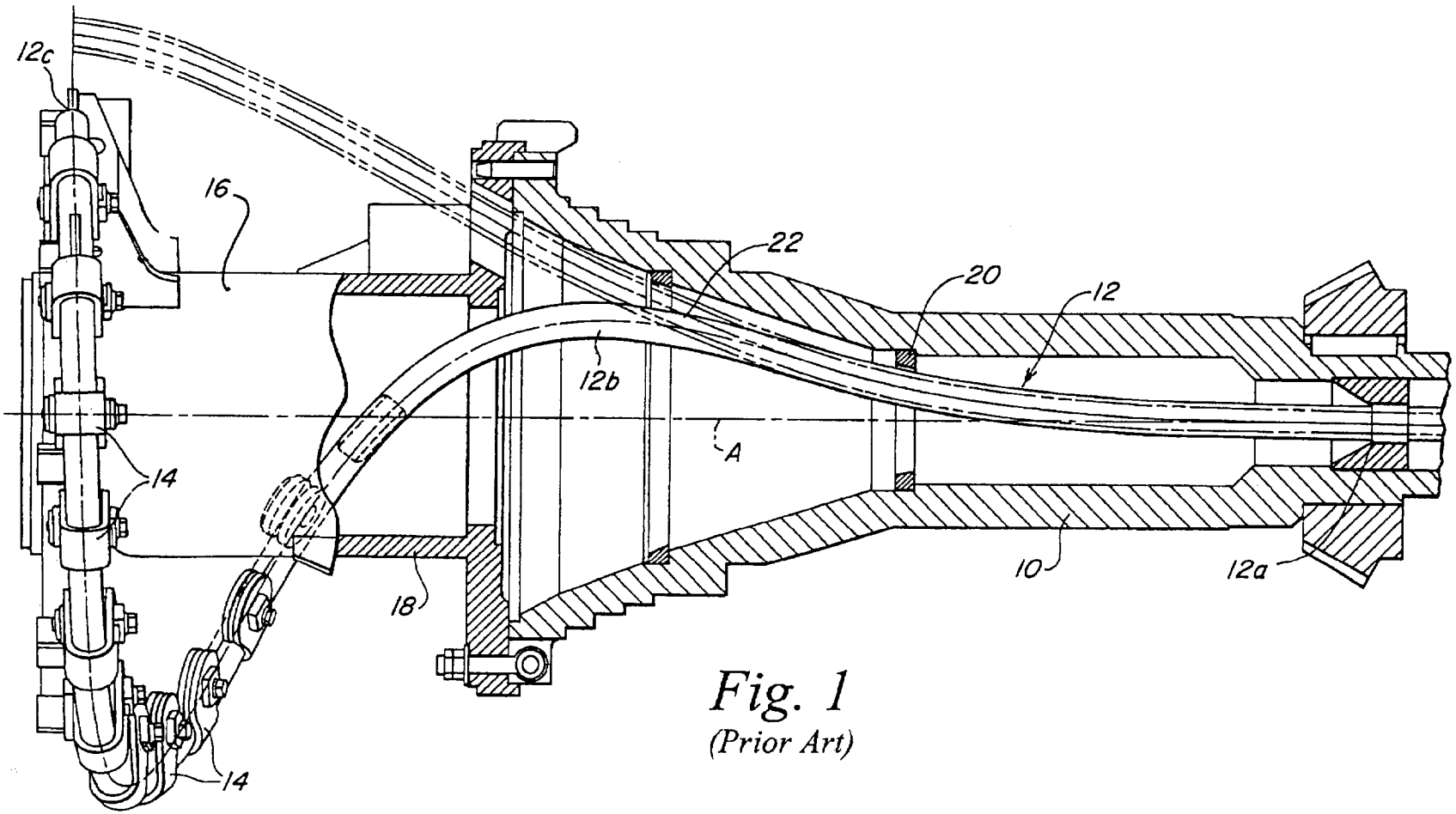
Fig. 1 (Prior Art)
FIG. 1 is a longitudinal sectional view taken through a prior art quill and laying pipe assembly.
Figures 2, 3:
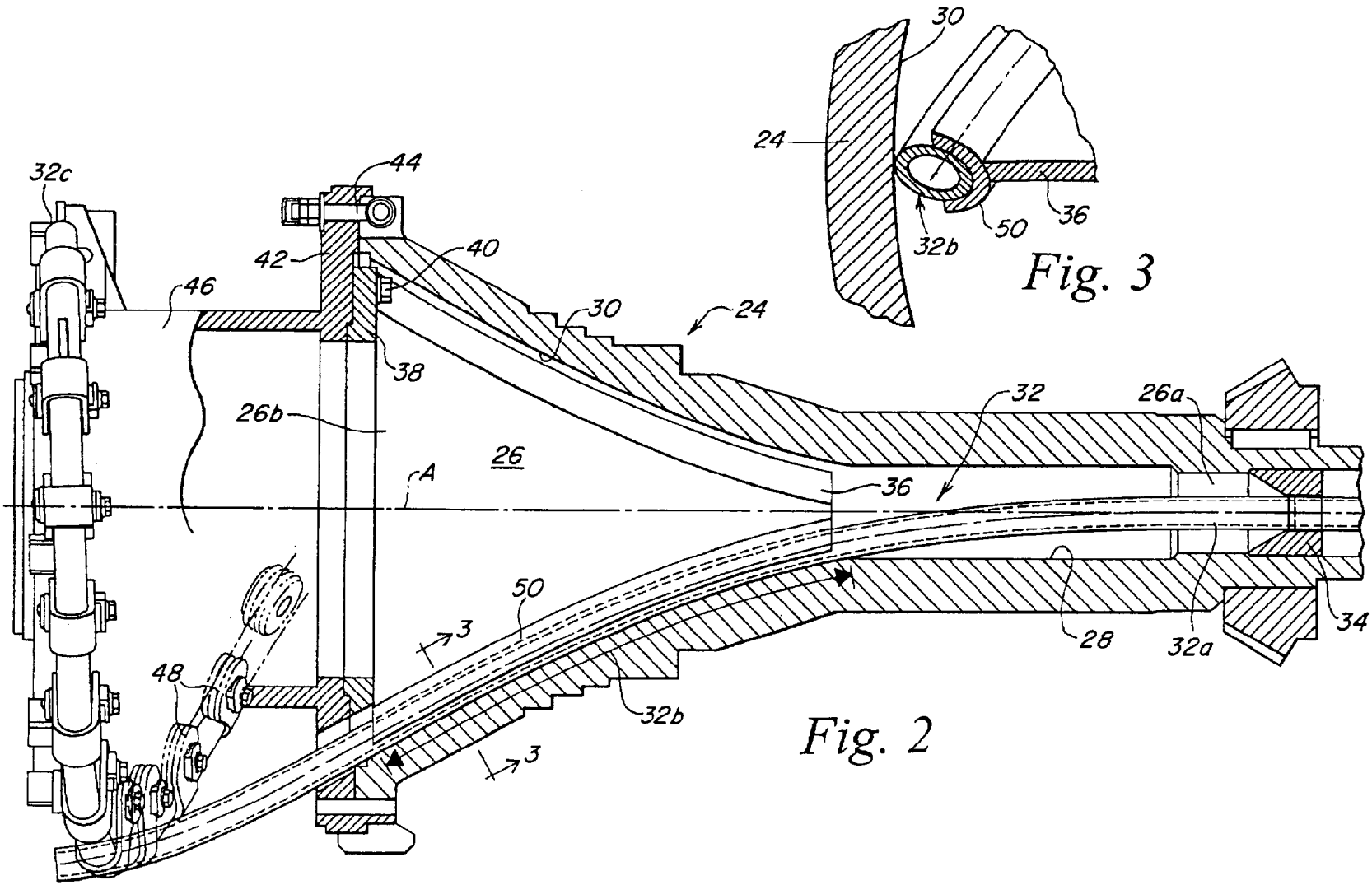
FIG. 2 is a sectional view similar to FIG. 1 showing a quill and laying pipe assembly in accordance with the present invention.
FIG. 3 is a sectional view on an enlarged scale taken along line 3—3 of FIG. 2.

In accordance with the present invention, and as shown in FIGS. 2 and 3, the tubular quill 24 has a central axis of rotation A and an interior surface surrounding a passageway 26 extending along axis A from a first end 26*a* to an opposite second end 26*b*. The interior surface has a stepped cylindrical section 28 leading from the first end 26*a* of the passageway 26 to a radially outwardly flared section 30 which in turn leads to the second end 26*b* of the passageway.

A laying pipe 32 is received in the passageway 26. The laying pipe has an entry end 32*a* aligned with axis A at the first passageway end 26*a*, and a three dimensionally curved intermediate portion 32*b* surrounded by the flared section 30 of the interior quill surface. The laying pipe projects axially from the second passageway end 26*b* to a delivery end 32*c* spaced radially from axis A.

The flared section 30 of the interior quill surface is configured to conform to and to radially inwardly confine the curved intermediate pipe portion 32*b*. A support means in the form of an annular insert 34 is received in the first end 26*a* of the passageway 26 to radially support the entry end 32*a* of the laying pipe 32.

Preferably, an internal pipe support 36 is axially received in the second end 26*b* of the passageway 26. The pipe support has an end flange 38 secured as at 40 to a collar 42 removably secured to the quill 24 by swing bolts 44 (only one being shown). Collar 42 supports a tubular boss 46 carrying brackets 48 for the axially projecting portion of the laying pipe 32.

The pipe support 36 has a peripheral three dimensionally curved track 50 configured and dimensioned to confine the intermediate pipe portion 32*b* against the complimentary shaped flared section 30 of the interior quill surface.

By thus closely confining the curved intermediate pipe portion 32*b*, deflection that might otherwise occur due to centrifugal forces and thermal expansion is thus beneficially reduced, with a concomitant reduction in wear of the laying pipe.

We claim:

1. A laying head for forming a longitudinally moving hot rolled product into a helix, said laying head comprising:

a tubular quill having a central axis of rotation and an interior surface surrounding a passageway extending along said axis and through said quill from a first end to an opposite second end having a peripheral end edge, said interior surface having a cylindrical section leading from said first end to a radially outwardly flared section which in turn leads to said second end;

a laying pipe received in said passageway, said laying pipe having an entry end aligned with said axis at the first end of said passageway, and having a curved intermediate portion surrounded by the flared section of the interior quill surface, said laying pipe projecting axially from the second end of said passageway to a delivery end spaced radially from said axis;

first support means at the first end of said passageway for radially supporting the entry end of said laying pipe; and second support means for supporting the curved intermediate portion of said laying pipe, said second support means projecting axially into said passageway from the peripheral end edge of said second end.

2. The laying head as claimed in claim 1 wherein said second support means is configured and dimensioned to confine the intermediate portion of said laying pipe against the flared section of the interior surface of said quill.

3. The laying head of claim 1 or 2 further comprising a circular collar detachably secured to said quill at the second end of said passageway, said second support means being carried by and projecting axially from said collar into said passageway.

4. A laying head for forming a longitudinally moving hot rolled product into a helix, said laying head comprising:

a tubular quill having a central axis of rotation and an interior surface surrounding a passageway extending along said axis and through said quill from a first end to an opposite second end, said interior surface having a radially outwardly flared section adjacent to said second end;

a laying pipe received in said passageway, said laying pipe having an entry end aligned with said axis at the first end of said passageway, and having a curved intermediate portion surrounded by the flared section of the interior quill surface, said laying pipe projecting axially from the second end of said passageway to a delivery end spaced radially from said axis;

first support means at the first end of said passageway for radially supporting the entry end of said laying pipe;

a circular collar detachably secured to said quill at the second end of said passageway; and second support means axially received in the second end of said passageway, said second support means being carried by and projecting axially from said collar into said passageway to support the curved intermediate portion of said laying pipe.

5. The laying head of claim 4 wherein the flared section of the interior surface of said quill is configured to conform to and to radially inwardly confine the curved intermediate portion of said laying pipe, and wherein said second support means is configured and dimensioned to outwardly confine the curved intermediate portion of said laying pipe against said flared section.

* * * * *